United States Patent [19]

Gallagher et al.

[11] 4,399,097

[45] Aug. 16, 1983

[54] PREPARATION OF III-V MATERIALS BY REDUCTION

[75] Inventors: Patrick K. Gallagher, Basking Ridge; Murray Robbins, Berkeley Heights, both of N.J.

[73] Assignee: Bell Telephone Laboratories, Incorporated, Murray Hill, N.J.

[21] Appl. No.: 288,000

[22] Filed: Jul. 29, 1981

[51] Int. Cl.[3] ..... C22C 12/00; C22C 28/00

[52] U.S. Cl. ..... 420/555; 420/576; 420/579; 420/580; 252/62.3 GA

[58] Field of Search ..... 75/134 T, 134 P, 149, 75/0.5 B, 62; 29/DIG. 22; 156/DIG. 8, DIG. 94, DIG. 70; 23/916; 423/299, 323; 252/62.3 GA, 518; 420/555, 576, 579, 580

[56] References Cited

U.S. PATENT DOCUMENTS 3,516,935 6/1970 Monforte et al. ..... 23/294 X
3,850,685 11/1974 Sakai ..... 75/134 T X
3,880,677 4/1975 Nishizawa et al. ..... 75/134 T X
4,026,994 5/1977 Tashiro et al. ..... 423/299

FOREIGN PATENT DOCUMENTS 50-15760 6/1975 Japan ..... 423/299
55-80709 6/1980 Japan ..... 423/299

OTHER PUBLICATIONS

Wade et al., "Compounds w/Phosphorus Arsenic and Antimony", Comprehensive Inorganic Chemistry, 1975, pp. 1100–1104.

*Primary Examiner*—L. Dewayne Rutledge
*Assistant Examiner*—David A. Hey
*Attorney, Agent, or Firm*—James H. Fox

[57] ABSTRACT

A method of producing III-V materials by reducing a complex salt in a hydrogen atmosphere is shown. For example, complex salts reduce to InP or GaAs. The salts are conveniently prepared by coprecipitation from a salt solution or by other methods. The stoichiometry can be modified by applying an overpressure of the more volatile element or elements during reduction.

10 Claims, 2 Drawing Figures

PREPARATION OF III-V MATERIALS BY REDUCTION

BACKGROUND OF THE INVENTION

1. Field of the Invention

This invention relates to a method of producing materials comprising the periodic table group III-V elements by the reduction of a precursor material.

2. Description of the Prior Art

Various III-V materials, including indium phosphide, gallium arsenide, etc., are widely used for semiconductor devices, optical waveguide devices, etc. These materials are typically formed by the direct reaction of the elements in a sealed system at high temperatures. Vapor phase reactions can also be used; for example, InP can be prepared by reacting $InCl_3$ and $PH_3$ in the vapor phase. In another case, metallic In can be reacted with flowing $PH_3$ to yield InP. Also, $In_2O_3$ can be reacted with $PH_3$ at high temperature to obtain InP. Gallium arsenide is typically prepared by similar reactions between metallic gallium and elemental arsenic, or compounds comprising arsenic, such as $AsH_3$.

In some cases, these reactions tend to be rather slow. For example, gallium and indium when melted tend to form a skin which slows down the reaction. The reactions involving reacting a metal with a vapor also tend to be rather slow. In addition, since the $PH_3$ or $AsH_3$ are very toxic, they are difficult to handle, leading to increased expense for these reactions. It is therefore desirable to find alternate methods of obtaining III-V materials.

SUMMARY OF THE INVENTION

We have invented a method of producing III-V material, wherein a salt comprising III-V material is reduced in hydrogen at an elevated temperature. To improve the stoichiometry of the reduced product, an excess amount of at least one element can be provided, typically by applying an overpressure of the more volatile element during reduction. The salt includes as the cationic species at least one element selected from a first group consisting of gallium and indium, and a complex anion comprising oxygen and at least one element selected from a second group consisting of antimony, arsenic, and phosphorus.

DETAILED DESCRIPTION

The following detailed description relates to a method of producing III-V compounds and solid solutions by the reduction of a salt.

The complex salt referred to herein comprises as a cation at least one element selected from a group consisting of gallium and indium, and a complex anion comprising oxygen and at least one element selected from the group consisting of antimony, arsenic, and phosphorus. Examples of complex salts produced by coprecipitation from ammonia-containing solutions include $M_a(NH_4)_bH_c(XO_4)_y$, where M is indium and/or gallium, X is at least one of phosphorus, arsenic, or antimony, where $a \leqq y$, and $(b+c)/3=y-a$. We have discovered that such salts will reduce in hydrogen at an elevated temperature to form a III-V compound or solid solution. Still other complex salts are possible. An excess amount of one or more of the III-V elements may be mixed in with the reduced III-V material. Steps can be taken to minimize the amount of excess material, as discussed below.

In practicing the present invention, the salt can be prepared in a number of ways from a number of different starting materials. One method that has been found to yield good results in coprecipitation of the salt from a solution. Both acidic and basic solutions have successfully been used for the coprecipitation. Another preparation technique is freeze drying of the salt, details of which can be found in U.S. Pat. No. 3,516,935, assigned to the same assignee as the present invention.

In practicing the present invention, an excess of the more volatile element, typically the group V element, can be maintained during the reduction process in order to obtain a stoichiometric proportion or other desired proportions of the elements. This excess of the more volatile element can be obtained by providing an overpressure of the more volatile element in the reducing atmosphere.

The solid product obtained upon reduction is typically a powder, which may become slightly sintered during the reduction process. This product can be further processed, as by crystal growing techniques known in the art, for semiconductor devices, lightwave devices, etc. However, the material may also find use substantially as formed upon reduction, typically for multicrystalline devices, including solar cells, etc. If desired, dopants can be introduced by inclusion in the salt material, or by inclusion in the reducing atmosphere, or by diffusion from a dopant source, or by other techniques.

Figure 1:
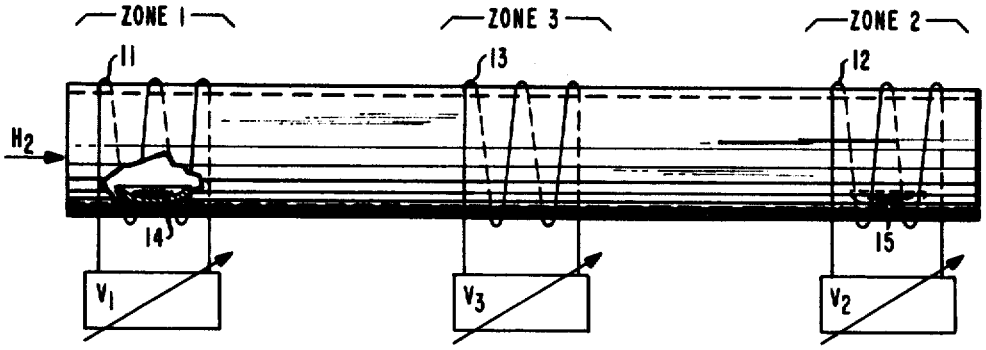
FIG. 1 shows a horizontal three-zone furnace suitable for practicing the present invention.

The above-noted principles will be more fully illustrated by means of the following examples. In Examples 1-6 below, the reduction is carried out in a furnace comprising a 1 inch diameter horizontal quartz tube; see FIG. 1. Heating is accomplished by a resistive element 11 wound around a first zone of the tube. In this apparatus, the salt is placed in a refractory boat 14 in the first zone, also hereinafter referred to as the reduction zone, and heated to a first temperature. Additional zones may be provided, as discussed in the examples below. Hydrogen gas flows through the furnace. The reduction zone temperature is typically in the range of 400 to 900 degrees Celsius, as further noted below, with a wider range being possible. To minimize loss of the more volatile group V element or elements, it is typically desirable to perform the reduction at as low a temperature as possible consistent with a suitably short reduction time for adequate reduction of the salt.

EXAMPLE 1

In this example, an indium acid salt is reduced to form indium phosphide. The salt was prepared by dissolving indium metal in $H_3PO_4$, with the solution being warmed to enhance the rate of reaction. A phosphate solution comprising $In^{+3}$ and $H_xPO_4^{-(3-x)}$ ions was obtained, where x ranges from 0 to 2. To this solution was added ammonium hydroxide in sufficient amount to obtain a pH of about 4. A precipitate of a complex phosphate salt was obtained, which was filtered with suction and washed with alcohol. It was then placed in a vacuum to remove the alcohol. This material was placed in the reduction zone of the furnace and reduced in flowing hydrogen gas at a temperature of 650 degrees Celsius for a period of approximately 1 hour. X-ray analysis determined that the resulting product was predominantly InP with a smaller amount of In present. Other reductions of material prepared as above, at varying temperatures, indicated that InP was produced at temperatures in excess of approximately 600 degrees Celsius.

EXAMPLE 2

In this example, GaAs is prepared by the reduction of a complex salt formed between gallium and $H_yAsO_4^{-(3-y)}$ ions, where y ranges from 0 to 2. The salt was prepared by oxidizing elemental gallium in HCl at an elevated temperature (less than 100 degrees Celsius) to increase the rate of oxidation. An excess amount of $As_2O_5$ was dissolved in the solution, and then an amount of $NH_4OH$ was added to obtain a pH of approximately 11. The material was precipitated, filtered, washed, and dried as in Example 1 above. The salt was placed in the reduction zone of the furnace and heated to 500 degrees Celsius in flowing $H_2$ gas for a period of 3 hours. The resulting reduced solid material was examined by X-ray diffraction and was found to be predominantly gallium arsenide, with a certain amount of gallium oxide left as a residue on the boat holding the sample. The same salt material as above was also reduced at 400 degrees Celsius; the reduction product had additional X-ray lines, indicating that materials others than gallium arsenide were also present.

In many instances, the product obtained by the reduction of the salt contains excess group III element, due to the typically higher volatility of the group V element, leading to reduction beyond a stoichiometric ratio, or beyond a desired nonstoichiometric ratio. To suppress this over-reduction or disassociation, an excess amount of the more volatile element or elements can be supplied. One method is by providing an overpressure of the more volatile element or elements. This may be accomplished, for example, by vaporizing an amount of the more volatile element in the reducing furnace. This technique will be more fully illustrated by means of the following examples.

EXAMPLE 3

In this example, an overpressure of phosphorus is applied to obtain more nearly stoichiometric InP by the reduction of a complex salt comprising indium and phosphorus. This overpressure was obtained by vaporizing elemental phosphorus in the furnace. In order to control the temperature of the boat containing the phosphorus, a second zone of the furnace was included in the reducing apparatus; see FIG. 1. This second zone comprised a separate winding 12 of a resistive heating element wound around the aforesaid quartz tube and controlled by a variac to establish the temperature of the phosphorus. The second zone was about 17 inches away from the first zone. A third zone with a third separately controlled temperature element 13 was established between the first and second zones. This third zone was kept at least 10 degrees Celsius higher than the second zone in order to prevent condensation of the phosphorus on the walls of the furnace. A quantity of phosphorus, approximately 1 to 2 grams, was placed in an alumina boat 15 and positioned in the second zone. Approximately 2 to 3 grams of the salt was placed in a boron nitride boat 14 in the first (reduction) zone. This salt was made as in Example 1 above, except that $NH_4OH$ was added in an amount sufficient to obtain a pH of 11 for the phosphate solution. The furnace was evacuated, and a flow of purified $H_2$ at a rate of approximately 100 to 300 $cm^3$/minute was started. The reduction zone was heated to between 700 and 750 degrees Celsius at a rate of 400 degrees Celsius per hour. When the temperature reached 200 degrees Celsius, zone 2 containing the phosphorus was brought to a temperature of from 400 to 450 degrees Celsius, and zone 3 was heated to about 500 degrees Celsius, in a period of about 30 minutes. Zones 2 and 3 were maintained at these temperatures while the reduction zone 1 rose to temperature, soaked for 3 hours, and finally cooled at its own rate. When zone 1 dropped below 400 degrees Celsius, the power to zones 2 and 3 was also terminated. An X-ray diffraction pattern of the reduction product obtained indicated that no discernible lines due to indium or phosphorus were present, showing that the reduction product was substantially indium phosphide. For comparison purposes, a comparable reduction of the salt produced from a high pH solution (pH ~ 11) took place as above except that no overpressure of phosphorus was applied. An X-ray analysis indicated the presence of metallic indium, as well as indium phosphide in the reduction product. In the reduction using the phosphorus overpressure, the weight loss of the phosphorus, the flow rate of the gas, and the time at temperature indicated a content of phosphorus in the gas of from 0.08 to 0.8 milligrams/liter ($10^{-4}$ to $10^{-5}$ atmospheres of $P_4$) over the temperature range used. This is adequate to suppress disassociation of InP in the temperature range used in the above reduction.

EXAMPLE 4

In this example, a salt comprising gallium and arsenic prepared as in Example 2 above is reduced to GaAs in the presence of an overpressure of As. The reduction zone was heated to a temperature of 550 degrees Celsius and held there for 3 hours while purified $H_2$ at a rate of 1 l/minute flowed through the reduction zone. Zone 2 containing elemental arsenic in an alumina boat was heated to 450 degrees Celsius for the same period of time, with zone 3 being maintained at a temperature of approximately 500 degrees Celsius during this time. The resulting solid reduction product was examined by X-ray diffraction and was determined to be substantially pure GaAs with no detectable presence of $Ga_2O_3$.

EXAMPLE 5

In this example, $In_{0.5}Ga_{0.5}As$ is prepared by the reduction of a salt comprising indium, gallium, and arsenic. The salt was prepared by dissolving 3.5 grams of gallium and 5.75 grams of indium (50-50 mole percent) in HCl, and then dissolving $As_2O_5$ in the solution. This resulting solution was then added to $NH_4OH$ to obtain a pH of approximately 9. A precipitate of the salt was obtained, which was filtered and dried. The salt was placed in the reaction zone and heated to 700 degrees Celsius for 3 hours while purified $H_2$, at a rate of approximately 1 l/minute, flowed through the reaction zone. An overpressure of arsenic was obtained during this period by heating elemental arsenic in an alumina boat in zone 2 to 450 degrees Celsius during this time. An X-ray analysis of the resulting material indicated that $In_{0.5}Ga_{0.5}As$ was obtained, with no detectable amounts of elemental In or $Ga_2O_3$.

EXAMPLE 6

In this example, InSb is prepared by the reduction of a salt comprising indium and antimony. The salt was prepared by first dissolving 11.5 grams of indium in a minimum of HCl. Next, 14 grams of antimony (with 12.2 grams being stoichiometric) was oxidized in aqua regia. These solutions were added to an excess of $NH_4OH$ to obtain a pH of about 10 to 11. A precipitate was obtained, which was filtered and dried. It was placed in the reduction zone of the furnace and reduced in flowing $H_2$ at 400 degrees Celsius for 3 hours. A mixture of InSb and excess Sb was obtained. Improved stoichiometry can be obtained by reducing the amount of Sb in the salt.

EXAMPLE 7

Figure 2:
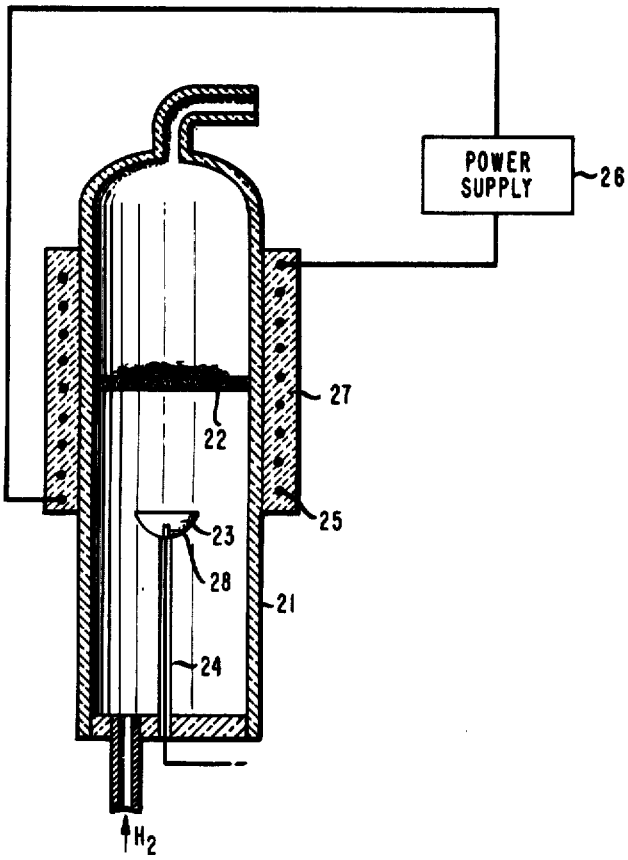
FIG. 2 shows a vertical fluidized bed furnace suitable for practicing the present invention.

In this example, reduction is accomplished in a vertical "fluidized bed" reduction furnace, shown in FIG. 2. This typically allows larger amounts of material to be reduced, as compared to the foregoing horizontal furnace. The vertical furnace comprises an electric heating element 25 wound around a grooved alumina core having a length of 24 inches and an inside diameter of 3 inches. Fiberglass sheet insulation was wrapped around the heating element to a thickness of about 6 inches. A silicon-controlled rectifier controlled the temperature of the heating element, which dissipated a maximum of about 2 kilowatts (10 amps at 208 volts). A quartz tube 21, about 5.2 cm outside diameter and 65 cm long, formed the reduction chamber inside the heating element. A porous quartz disc 22, located approximately in the middle of the furnace, forms a stage onto which the salt is placed. A quartz bulb 23 holds the more volatile element when an overpressure of such element is desired. The vertical position of this bulb is controlled by rod 24. The temperature of the material in the bulb can be changed by varying the distance the bulb is inserted into the furnace. A thermocouple 28 inserted through the hollow rod 24 measures the temperature in the bulb.

This apparatus was used to reduce a complex salt comprising indium and phosphorus, prepared as in Example 1 above. Twenty grams of this salt was placed on porous disc 22, and 5 grams of phosphorus was placed in bulb 23. The salt was heated to about 790 degrees Celsius, and the position of the bulb was adjusted to provide a temperature of the phosphorus of about 310 to 340 degrees Celsius. By reducing the salt in $H_2$ gas flowing at a rate of 2 l/minute for 4 hours, indium phosphide was obtained as the solid reduction product. X-ray analysis indicated no detectable amounts of other components.

In the above examples, the X-ray analysis technique utilized had a resolution of approximately 5 percent, so that in the cases wherein no elemental indium or gallium or oxides thereof were detected, less than 5 percent of these were present in that form in the reduced material.

Although the above examples illustrate overpressures produced by vaporizing the more volatile elemental material, overpressures can also be produced from compounds comprising the more volatile material. For example, the use of phosphine gas ($PH_3$) is known in the art to maintain stoichiometry for InP compounds during high temperature processing.

While a single salt conveniently contains all the desired III-V elements, two or more salts can be used. For example, a salt containing indium and phosphorus can be mixed with a salt containing gallium and arsenic. Upon reduction of the salts, subsequent further heating can be used to obtain interdiffusion of the species to obtain a solid solution of indium, gallium, arsenic, and phosphorus. For this purpose, coprecipitation of the salts is an advantageous preparation technique to obtain interdiffusion distances of typically less than 1 micron, to minimize the diffusion time.

It can be seen by persons skilled in the art that numerous variations on the above technique can be envisioned and are included herein. For example, as noted above, various dopants may be included in the salt or applied as an overpressure for doping the resulting material as desired. Other reduction furnace configurations can be employed. Other methods may be used to obtain an overpressure of the more volatile element. Various techniques can be used to obtain the salt material. All such variations and deviations which rely on the teachings through which the present invention has advanced the art are considered to be within the spirit and scope of the present invention.

What is claimed is:

1. A method of producing a material comprising at least one first element selected from the group consisting of gallium and indium, and at least one second element selected from the group consisting of antimony, arsenic, and phosphorus, characterized by reducing in an atmosphere comprising hydrogen at least one salt of the form $Ma(NH_4)_b\,Hc(XO_4)_y$, where M is said at least one first element, and X is said at least one second element, where $a \leqq y$ and $(b+c)/3 = y - a$.

2. The method of claim 1 wherein an overpressure of at least one second element is applied to said salt during said reducing.

3. The method of claim 1 wherein said material comprises indium phosphide.

4. The method of claim 1 wherein said material comprises gallium arsenide.

5. The method of claim 1 wherein said material comprises indium antimonide.

6. The method of claim 1 wherein said material comprises a solid solution comprising at least three elements selected from the group consisting of indium, gallium, antimony, arsenic, and phosphorus.

7. The method of claim 1 wherein said salt is prepared by coprecipitation from a solution.

8. The method of claim 1 wherein at least two of said salts are reduced, wherein the salts are so formed that the diffusion distance between said first and second elements is less than 1 micrometer.

9. The method of claim 1 wherein the amount of said second element in said salt is substantially greater than the amount of said first element in said salt, whereby a desired composition of said material is obtained.

10. A compound or solid solution produced according to the method of claim 1.

* * * * *